US008176969B2

(12) United States Patent
Dixon et al.

(10) Patent No.: US 8,176,969 B2
(45) Date of Patent: May 15, 2012

(54) APPARATUS FOR CONTINUOUS STRIP CASTING

(75) Inventors: Andrew Edward Dixon, Panania (AU); Gary McQuillis, Blytheville, AR (US); Rama Ballav Mahapatra, Brighton-Le-Sands (AU); Leigh Wolley, Coniston (AU)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 13/170,394

(22) Filed: Jun. 28, 2011

(65) Prior Publication Data

US 2011/0253336 A1 Oct. 20, 2011

Related U.S. Application Data

(62) Division of application No. 12/167,795, filed on Jul. 3, 2008, now Pat. No. 7,984,748.

(51) Int. Cl.
*B22D 11/14* (2006.01)
*B22D 11/16* (2006.01)

(52) U.S. Cl. ..... 164/413; 164/154.2; 164/154.5; 164/451; 164/452; 164/454

(58) Field of Classification Search ..... 164/154.2, 164/154, 5, 413, 428, 429, 451, 452, 454, 164/479, 480
See application file for complete search history.

(56) References Cited

U.S. PATENT DOCUMENTS

| | | | |
|---|---|---|---|
| 5,720,335 | A | 2/1998 | Osada et al. |
| 5,853,043 | A | 12/1998 | Takeuchi et al. |
| 6,776,218 | B2 | 8/2004 | Glutz et al. |
| 2004/0123973 | A1 | 7/2004 | Blejde et al. |
| 2007/0175608 | A1 | 8/2007 | Mahapatra et al. |
| 2008/0047681 | A1 | 2/2008 | Nikolovski et al. |

FOREIGN PATENT DOCUMENTS

| | | | |
|---|---|---|---|
| EP | 0387006 | | 9/1990 |
| FR | 2758487 | | 7/1998 |
| JP | 2000326057 | A * | 11/2000 |
| KR | 2001058175 | A * | 7/2001 |
| KR | 797990 | B1 * | 1/2008 |
| WO | 0226422 | | 4/2002 |

(Continued)

OTHER PUBLICATIONS

EPO machine translation of the abstract of KR 2001058175 A, Jul. 5, 2001.*

(Continued)

*Primary Examiner* — Jessica L Ward
*Assistant Examiner* — Kevin E Yoon
(74) *Attorney, Agent, or Firm* — Hahn, Loeser & Parks, LLP; Arland T. Stein

(57) ABSTRACT

An apparatus for continuously casting thin strip includes a caster having a pair of casting rolls having a nip there between capable of delivering cast strip downwardly from the nip and an first enclosure capable of forming a protective atmosphere into which the strip can be formed in loop to extend over a plurality of rollers into pinch rolls with the strip having a strain of less than 0.4%, which may be provided by a plurality of rollers at entry of the strip into the pinch rolls to carry the strip into the pinch rolls, with at least a first entry roller having a diameter between 200 and 650 millimeters and being below a majority of other rollers.

8 Claims, 13 Drawing Sheets

FOREIGN PATENT DOCUMENTS

WO 03086683 10/2003

OTHER PUBLICATIONS

EPO machine translation of the abstract of KR 797990 B1, Jan. 28, 2008.*

Australian Patent Office International-Type Search Report, Australian Application No. 2008905279, mailed Nov. 7, 2008.

International Search Report and Written Opinion in PCT/AU2009/000860, dated Aug. 6, 2009.

* cited by examiner

| FIG. | Description of Configuration | Estimated Maximum Strain (%) |
|---|---|---|
| 1 | All rolls 210 mm in diameter | 0.7 |
| | Tops of all rolls aligned horizontally | |
| | | |
| 5 | All rolls 250 mm in diameter | 0.7 |
| | All remaining rolls 210 mm in diameter | |
| | Tops of all rolls aligned horizontally | |
| | | |
| 6 | All rolls 350 mm in diameter | 0.5 |
| | All remaining rolls 210 mm in diameter | |
| | Tops of all rolls aligned horizontally | |
| | | |
| 7 | 1st roll 450 mm in diameter | 0.4 |
| | All remaining rolls 210 mm in diameter | |
| | Tops of all rolls aligned horizontally | |
| | | |
| 8 | 1st roll 600 mm in diameter | 0.3 |
| | All remaining rolls 210 mm in diameter | |
| | Tops of all rolls aligned horizontally | |
| | | |
| 9 | All rolls 210 mm in diameter | 0.3 |
| | 1st Roll lowered 198 mm | |
| | All remaining rolls aligned horizontally | |
| | | |
| 10 | All rolls 210 mm in diameter | 0.25 |
| | 1st roll lowered 513.26 mm | |
| | 2nd roll lowered 198 mm | |
| | All remaining rolls aligned horizontally | |
| | | |

Fig. 11

APPARATUS FOR CONTINUOUS STRIP CASTING

CROSS-REFERENCE TO RELATED APPLICATIONS

This application is a divisional application of U.S. application Ser. No. 12/167,795, filed on Jul. 3, 2008, which is herein incorporated by reference in its entirety.

BACKGROUND AND SUMMARY

This invention relates in general to the casting of metal strip by continuous casting in a twin roll caster.

In a twin roll caster, molten metal is introduced between a pair of counter-rotated laterally positioned casting rolls that are internally cooled so that metal shells solidify on the moving casting surfaces and are brought together at a nip between the rolls to form a solidified strip product, delivered downwardly from the nip between the rolls. The term "nip" is used herein to refer to the general region at which the casting rolls are closest together. The molten metal may be poured from a ladle into a smaller vessel or series of smaller vessels from which it flows through a metal delivery nozzle located above the nip, forming a casting pool of molten metal supported on the casting surfaces of the rolls immediately above the nip and extending along the length of the nip. This casting pool is usually confined between side plates or dams held in slidable engagement with end surfaces of the casting rolls against outflow.

Further, the twin roll caster may be capable of continuously producing cast strip from molten steel through a sequence of ladles. Pouring the molten metal from the ladle into smaller vessels before flowing through the metal delivery nozzle enables the exchange of an empty ladle with a full ladle without disrupting the casting campaign of cast strip.

The formed cast strip is delivered downwardly from the nip of the casting rolls into a first enclosure containing a protective atmosphere where the strip commences a cooling process after leaving the nip. After commencement of the campaign, the strip typically hangs in the enclosure in a loop before moving over a roller table through a first of pinch rolls. The strip then proceeds through the first set of pinch rolls typically to a roll mill to improve strip surface qualities, and to achieve desired thickness and mechanical properties, and thereafter to a cooling enclosure and a second set of pinch rolls for tension control, and then to a coiler.

The conditions provided for the just cast strip in the first enclosure influences the quality of the cast strip. We have found that microcracks in the surface of the finish cast strip can be traced to strain in the strip in the first enclosure as it moves through the loop and across the roller table into the first pinch rolls. Additionally, we have found that the oxygen and water vapor levels of the atmosphere in the first enclosure increase oxidation and scale formed on the strip and otherwise influence the surface quality of the cast strip. The present invention provides an apparatus for continuously casting thin strip having improved conditions for the strip after casting in the first enclosure.

Disclosed is an apparatus for continuously casting metal strip comprising:

a. a caster having a pair of casting rolls laterally positioned to form a nip there between capable of delivering cast strip downwardly from the nip, b. a metal delivery system capable of forming a casting pool supported on casting surfaces of the casting rolls above the nip with side dams adjacent the ends of casting rolls to confine the casting pool, and c. a first enclosure beneath the casting capable of forming a protective atmosphere into which the strip can be delivered from the casting rolls, and in which the strip can be formed in loop and extend over rollers into pinch rolls with the strip having a strain of less than 0.4%.

The loop in the first enclosure of apparatus for continuously casting thin strip may be between 2.5 and 4.5 meters in height from the nip.

The strain of less than 0.4% may be provided in the cast strip in the first enclosure by providing the plurality of rollers at entry of the strip into the pinch rolls to carry the strip, with at least a first entry roller having a diameter between 200 and 650 millimeters and being below a majority of other rollers. Alternatively, a strain of less than 0.3% may be provided in the strip in the first enclosure by providing the plurality of rollers at entry of the strip into the pinch rolls to carry the strip, with at least a first entry roller having a diameter between 200 and 650 millimeters and being below a majority of other rollers.

The apparatus for continuously casting thin strip may further comprise gas nozzles positioned adjacent to the entry of the cast into the first enclosure and capable of directing a gas towards the strip and inhibiting the flow of gas from the first enclosure upwardly to beneath the casting rolls.

The apparatus for continuously casting thin strip may comprise at least one additional enclosure between the casting rolls and a rolling mill through which the strip passes with an atmospheric pressure less than a pressure in the first enclosure and greater than the atmospheric pressure in a next proceeding enclosure. The atmospheric pressure in the first enclosure may be less than 0.5 inches on a water gauge, and the atmospheric pressure of each subsequent enclosure may be at least 0.03 inches less on a water gauge than an immediately preceding enclosure.

Further, the apparatus for continuously casting thin strip may further comprise a regulating device where the atmospheric pressure in each enclosure is maintained by a closed loop regulating device.

Various advantages of the present invention will become apparent from the following detailed description and accompanying drawings.

BRIEF DESCRIPTION OF THE DRAWINGS

FIG. 11 is a data table of the maximum loop strains of the configurations of FIGS. 5-10.

DETAILED DESCRIPTION OF THE PREFERRED EMBODIMENT

Figure 1:
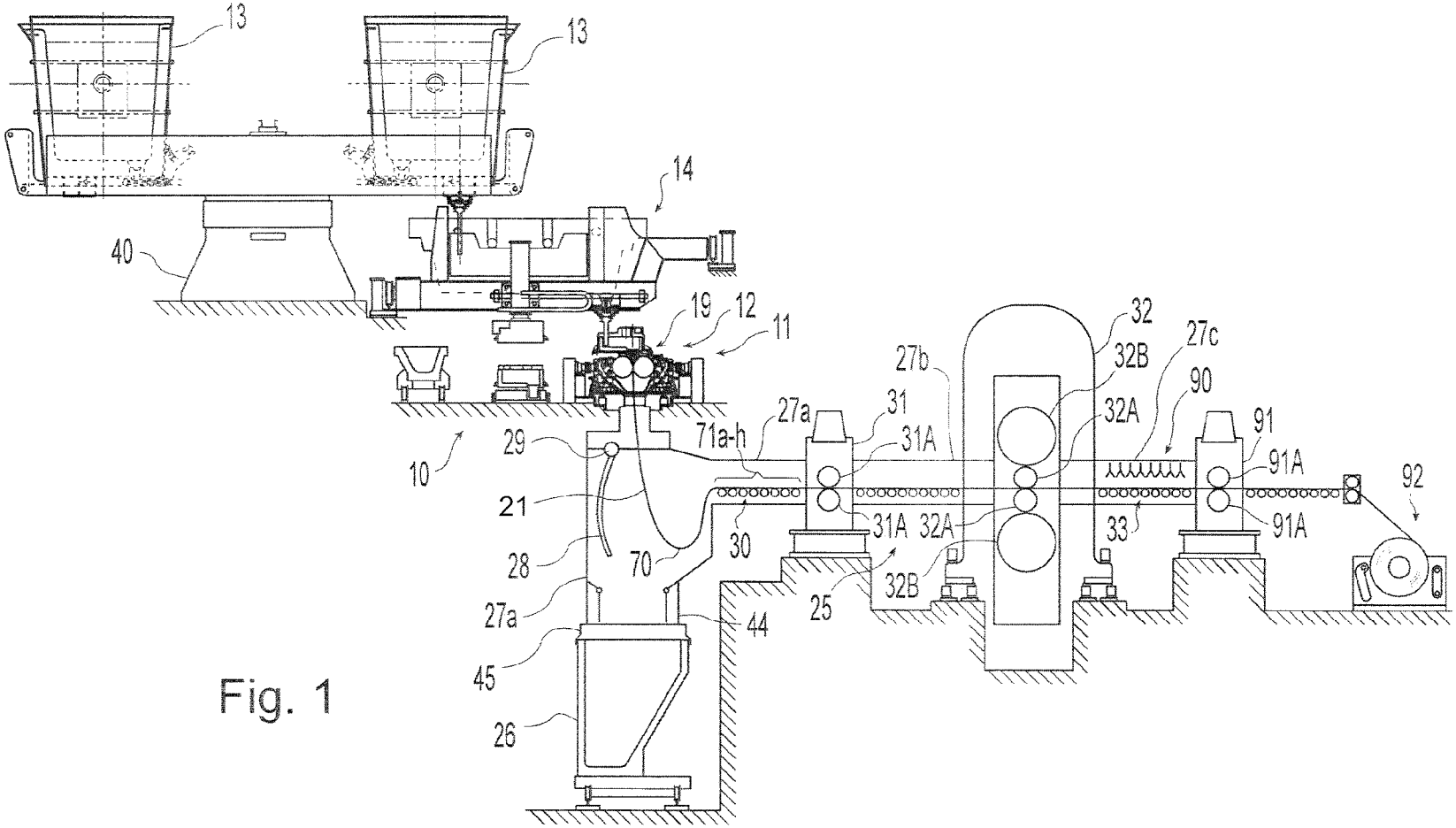
FIG. 1 is a diagrammatical side view of a twin roll caster according to one embodiment of the present disclosure.
Figure 2:
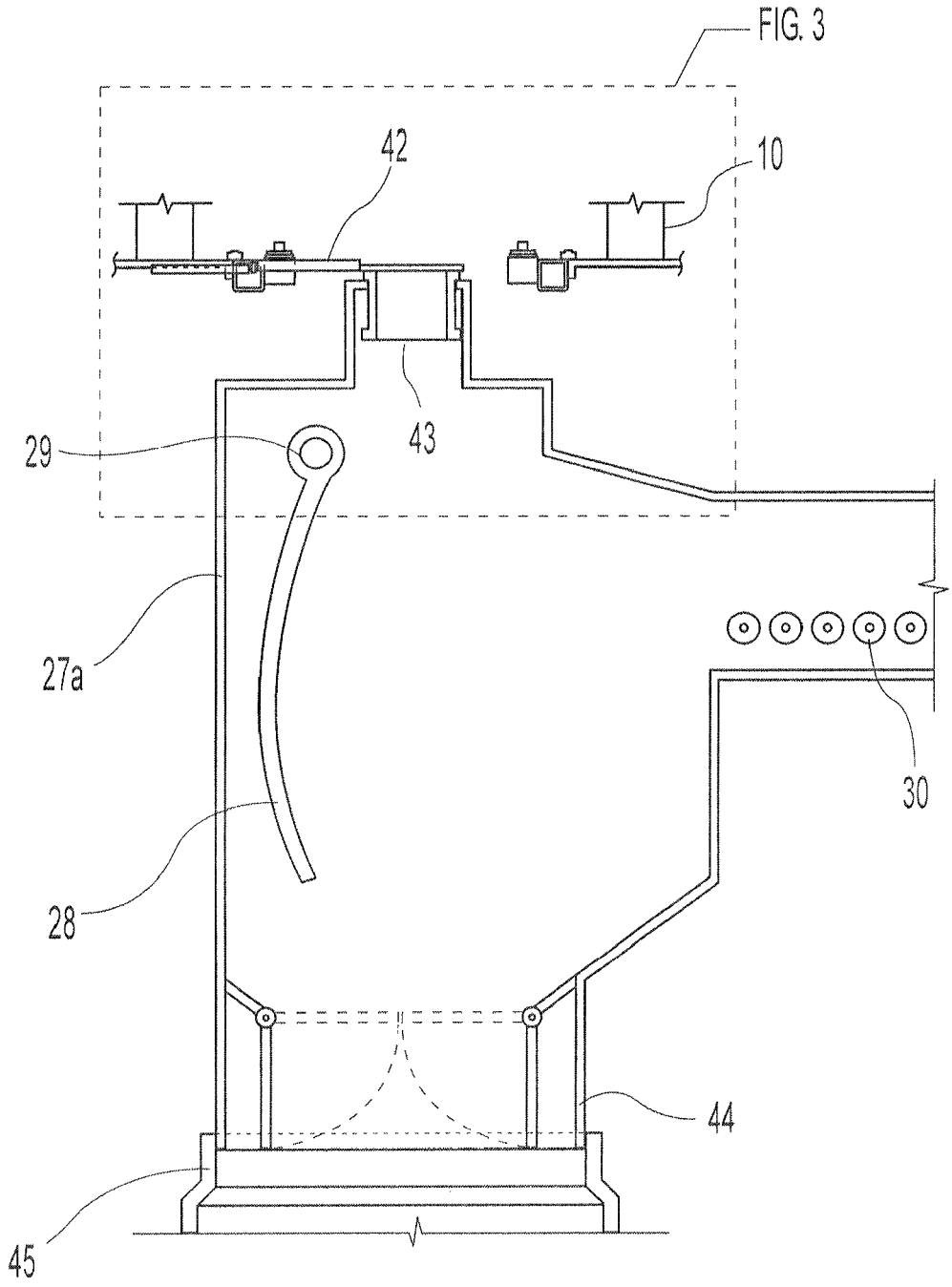
FIG. 2 is a partial sectional of the first enclosure of the twin roll caster of FIG. 1.

Referring now to the drawings, there is illustrated in FIGS. 1 through 4, a twin roll caster is illustrated that comprises a main machine frame 10 and supports a pair of counter-rotatable casting rolls 12 mounted in a module in a roll cassette 11. The casting rolls 12 have casting surfaces laterally positioned to form a nip there between.

Molten metal is supplied from a ladle 13 through a metal delivery system 14 to a metal delivery nozzle, or core nozzle, positioned between the casting rolls 12 above the nip. The delivered molten metal is delivered to form a casting pool 19 of molten metal above the nip supported on the casting surfaces of the casting rolls 12. This casting pool 19 is confined in the casting area at the ends of the casting rolls 12 by a pair of side closures or side dams. The upper surface of the casting pool 19 (generally referred to as the "meniscus" level) may rise above the lower end of the delivery nozzle so that the lower end of the delivery nozzle is immersed within the casting pool. The casting area includes a protective atmosphere above the casting pool 19 to inhibit oxidation of the molten metal in the casting area.

A conventional ladle 13 is typically supported on a rotating turret 40. For metal delivery, the ladle 13 is positioned over a movable tundish in the casting position to fill the tundish with molten metal. The movable tundish allows molten metal to flow from the tundish to a transition piece or distributor in the casting position. From the distributor, the molten metal flows to the delivery nozzle positioned between the casting rolls 12 above the nip.

The casting rolls 12 are internally water cooled so that as the casting rolls 12 are counter-rotated, the casting surfaces move into contact with and through the casting pool 19 to solidify shells on the casting surfaces with each revolution of the casting rolls 12. The shells are brought close together at the nip between the casting rolls to produce a solidified thin cast strip product 21 delivered downwardly from the nip.

As shown FIG. 1, the cast strip 21 exits downwardly from the nip between the casting rolls, and passes into first enclosure 27A containing a protective atmosphere of nitrogen with less than 5% oxygen and less than 0.3% water vapor. The protective atmosphere may, for example, also contain 1% to 3% hydrogen. The first enclosure 27A may be formed by a number of separate water-jacketed wall sections that fit together at various seal connections to form a continuous enclosure wall that permits control of the atmosphere within the enclosure. In first enclosure 27A, cast strip 21 is formed into a loop 70, as described below, and across a first roller table 30 to a first pinch roll stand 31, with first pinch rolls 31A to provide tension of the strip. Upon exiting the first pinch roll stand 31, the thin cast strip may pass along a second roller table 25 and through a hot rolling mill 32, comprising a pair of backup rolls 32B and a pair of work rolls 32A forming a gap capable of rolling hot strip delivered from the casting rolls. In the hot rolling mill 32, the cast strip may be hot rolled to reduce the strip to a desired thickness, and improve the strip surface quality and flatness. The work rolls 32A have work surfaces corresponding to the desired strip profile. The second roller table 25 may sloped away from the first pinch roll stand 31 and toward the rolling mill 32 to prevent water from entering the first enclosure 27A.

The rolled strip then passes onto a third roller table 33, where it may be cooled by contact with a coolant, such as water, supplied via water jets 90 or other suitable means, and by convection and radiation. In any event, the rolled strip may then pass through a second pinch roll stand 91, with second pinch rolls 91A, to provide tension of the strip, and then to a coiler 92. For example, the cast strip may be between about 0.3 and 2.0 millimeters in thickness as cast before hot rolling.

At the start of the casting operation, a short length of imperfect strip is typically produced as casting conditions stabilize. After the casting operation is stabilized, the casting rolls are moved apart slightly and then brought together to cause the leading end of the strip to break away forming a clean head end of the following cast strip. The imperfect material drops into a scrap receptacle 26, which is movable on scrap receptacle guides (such as rails). The scrap receptacle 26 is located in a scrap receiving position beneath the caster and forms part of the first enclosure 27A. The first enclosure 27A may be water cooled.

At start-up, a water-cooled apron 28, normally hangs downwardly from a pivot 29 to one side in the first enclosure 27A, is then swung into position to guide the clean end of the cast strip 21 onto the first roller table 30 that feeds it to the first pinch rolls 31A. The apron 28 is then retracted back to its hanging position to allow the cast strip 21 to hang in a loop 70 beneath the casting rolls in first enclosure 27A before it passes to the first roller table 30 where it engages a succession of guide rollers 71A through 71H. The loop 70 in the first enclosure 27A may be between 2.5 and 4.5 meters in height and rotational speed of the casting rolls 12 and first pinch rolls 31A are varied to control and maintain the height of loop 70.

Additionally, the scrap receptacle 26 may be capable of attaching with the first enclosure 27A so that the enclosure is capable of supporting a protective atmosphere immediately beneath the casting rolls 12 in the casting position. The first enclosure 27A includes an opening in a lower portion of the enclosure 44, the lower enclosure portion 44, providing an outlet for scrap to pass from the first enclosure 27A into the scrap receptacle 26 in the scrap receiving position. The lower enclosure portion 44 may extend downwardly as a part of the first enclosure 27A, the opening being positioned above the scrap receptacle 26 in the scrap receiving position. As used in the specification and claims herein, "seal", "sealed", "sealing", and "sealingly" in reference to the scrap receptacle 26, first enclosure 27A, and any and all other related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. When sealed, the first enclosure 27A and scrap receptacle 26 are filled with a desired gas, such as nitrogen, to reduce the amount of oxygen in the enclosure and provide a protective atmosphere for the cast strip. The protective atmosphere may, for example, also contain 1% to 3% hydrogen.

The first enclosure 27A may include an upper collar portion 43 supporting a protective atmosphere immediately beneath the casting rolls in the casting position. The upper collar portion 43 may be moved between an extended position capable of supporting the protective atmosphere immediately beneath the casting rolls and an open position enabling an upper cover 42 to cover the upper portion of the first enclosure 27A.

When the casting rolls 12 are in the casting position, the upper cover 42 is moved to uncover the upper portion of the first enclosure 27A, and the upper collar portion 43 is moved to the extended position closing the space between a housing portion adjacent the casting rolls 12 and the first enclosure 27A. The upper collar portion 43 may be provided within or adjacent the first enclosure 27A and adjacent the casting rolls 12, and may be moved by a plurality of actuators (not shown) such as servo-mechanisms, hydraulic mechanisms, pneumatic mechanisms, and rotating actuators. The twin roll caster illustratively may be of the kind described in U.S. patent application Ser. No. 12/050,987, and reference may be made to that for appropriate constructional details.

In operation, the strip leaves the nip between the casting rolls typically at a temperature between 1300 and 1450° C. To prevent oxidation and scaling of the strip, the metal strip is cast downwardly into the first enclosure 27A supporting a protective atmosphere immediately beneath the casting rolls in the casting position. The first enclosure 27A may extend along the path of the cast strip until the first pinch roll stand 31, and a second enclosure 27B may extend along the path of the cast strip from the first pinch roll stand 31 until the hot rolling mill 32 to reduce oxidation and scaling. After the hot rolling mill 32, the rolled strip then passes onto the third roller table 33 where the strip may be cooled by the water jets 90. A third enclosure 27C may be provided extending from adjacent the hot rolling mill 32 through which the cast strip moves during cooling. Further, A cast strip, for example having less than 2 μm scale, exiting the cooling zone may be further processed, such as by cold rolling.

A protective atmosphere, for example, of nitrogen with less than 5% oxygen, may be provided in the enclosures 27A, 27B, and 27C. The protective atmosphere may include steam generated from vaporizing water. Nitrogen or other inert gas may be provided in the enclosures 27A, 27B, and 27C to inhibit oxidation of the strip. The protective atmosphere may, for example, also contain 1% to 3% hydrogen. In addition, water vapor generated by the cooling water boiling adjacent the surface of the strip may be retained in the enclosure 27C. The generated water vapor in the protective atmosphere further inhibits oxidation by inhibiting the inflow of air containing reactive oxygen. By retaining the water vapor in the enclosure 27C, less nitrogen may be used to inhibit oxidation, further reducing cost of operation. The cooling water may then be directed from any of the enclosures 27C to a reclamation system capable of returning the coolant to the closed loop system, or delivering the coolant to a waste management system.

Sensors such as x-ray gauges or other instrumentation may be provided above the roller tables 30, 25 and 33, to monitor thickness variations in the strip, surface quality, or other strip properties. Nitrogen may be introduced into the enclosures 27A, 27B, and 27C as desired in different locations, such as adjacent the instrumentation to inhibit water spray and steam from affecting measurements in the protective atmosphere.

Figure 3:
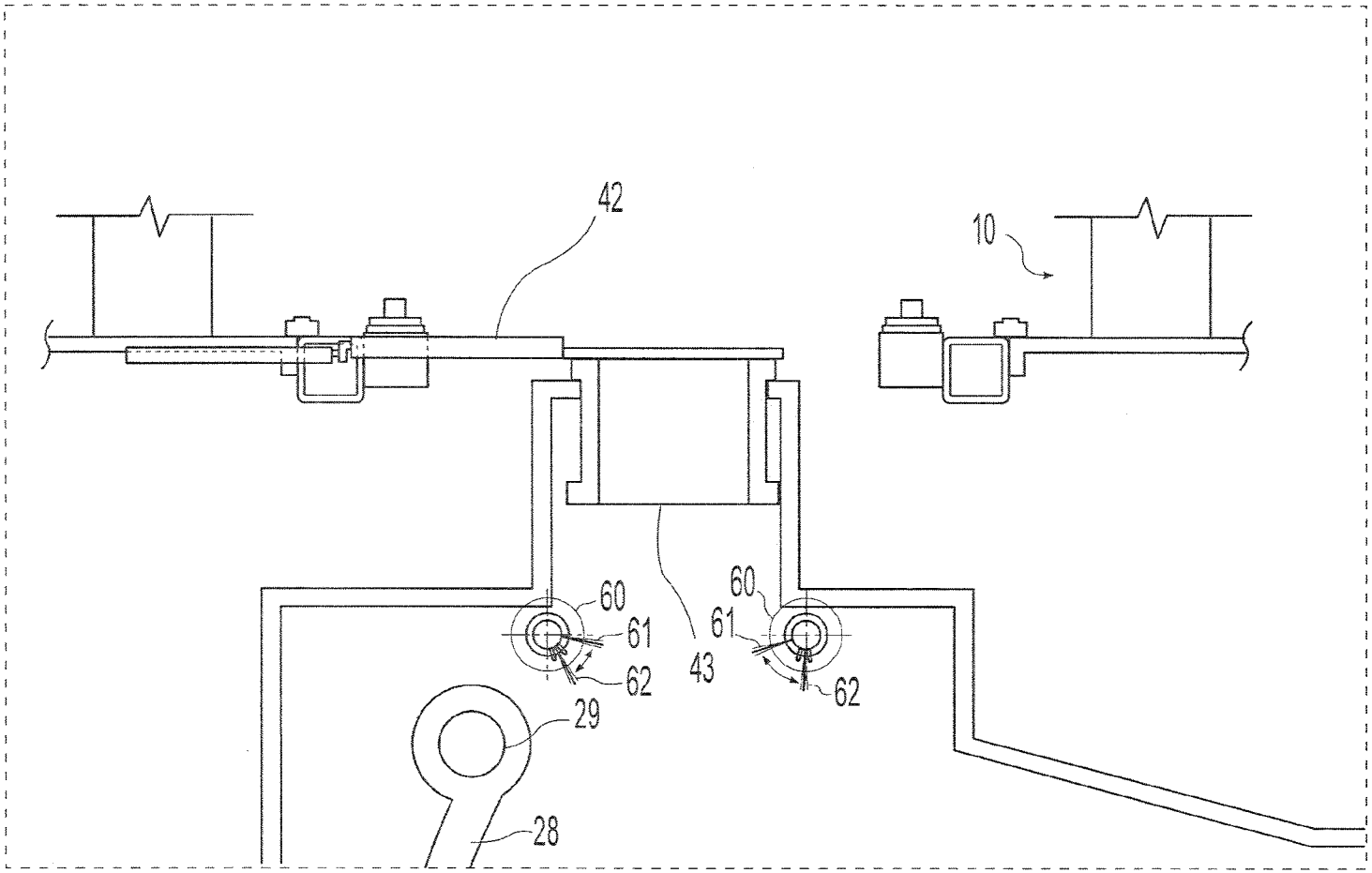
FIG. 3 is an enlarged view of a portion of FIG. 2.
Figure 4:
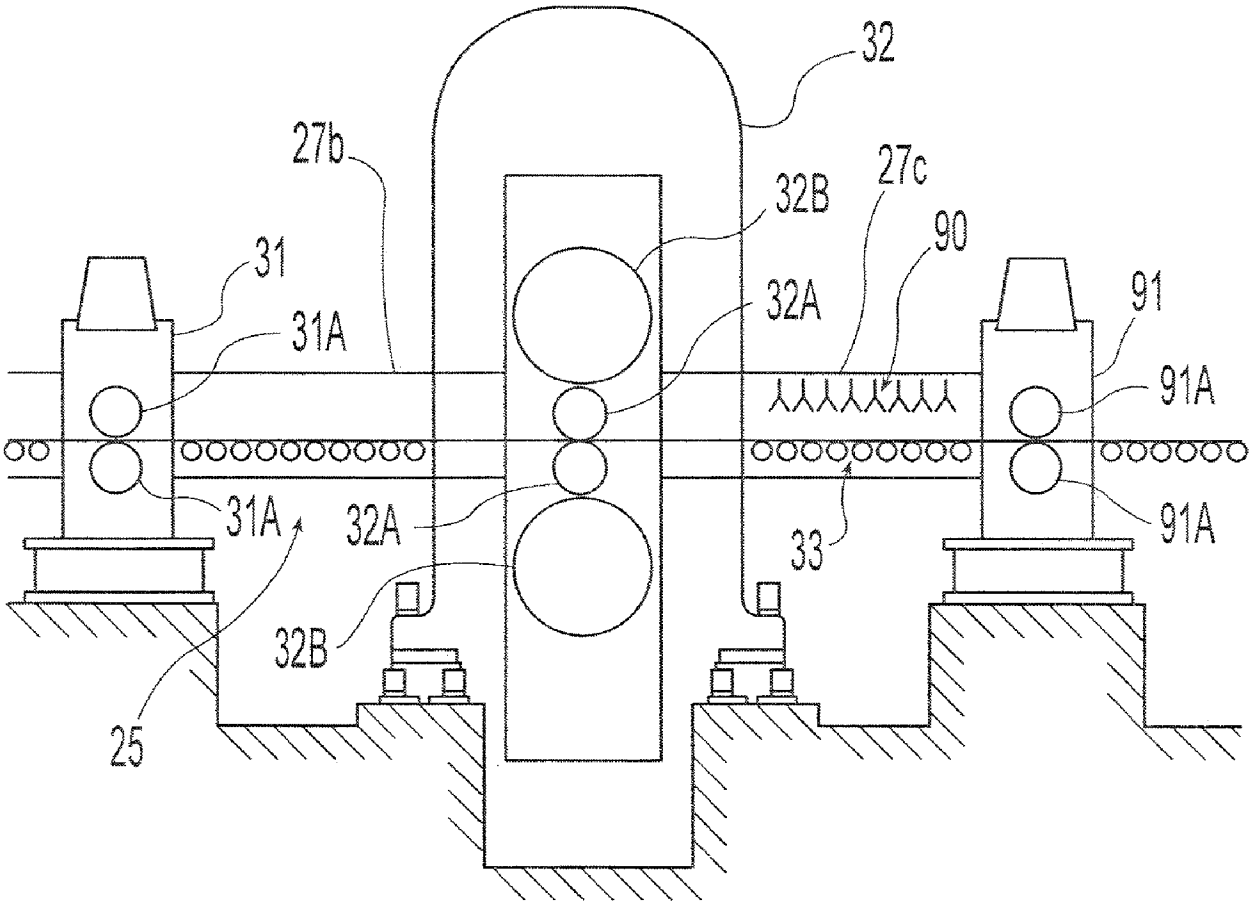
FIG. 4 is a partial sectional of the second and third enclosures of the twin roll caster of FIG. 1.

As best shown in FIG. 3, a pair of articulated gas headers 60, for example gas nozzles, are provided in the first enclosure 27A. The gas headers 60 are adjusted to provide gas jets directed towards the cast strip in first enclosure as illustrated by the angle between exemplary jets 61 and 62. The gas headers 60 are provided to prevent the gases of protective atmosphere in first enclosure 27A from exiting the first enclosure 27A to the casting rolls 12 and also directly maintain a protective atmosphere adjacent the cast strip 21. Thus, the gas headers 60 are adjacent the entry of the cast strip 21 to the first enclosure 27A and capable of directing a gas toward the cast strip 21 to inhibit the flow of gas from the first enclosure 27A upwardly to beneath the casting rolls 12.

In order to control the conditions of the cast strip 21 during cooling, atmospheric pressure differentials are setup across the enclosures 27A, 27B, and 27C. For example the atmosphere is the first enclosure 27A may be at 0.15 inches water gauge, while the atmosphere in the second enclosure 27B may be at 0.11 inches water gauge and the atmosphere in the third enclosure 27C may be at 0.08 inches water gauge.

In one method of control, the atmospheric pressure in the first enclosure 27A is less than 0.5 inches on a water gauge, and the atmospheric pressure of each of the subsequent enclosures 27B and 27C is at least 0.03 inches on a water gauge less than the immediately preceding enclosure.

Thus, the casting apparatus has the second enclosure 27B between the casting rolls 12 and the rolling mill 32 through which the cast strip 21 passes with an atmospheric pressure less than the pressure in the first enclosure 27A and greater than the atmospheric pressure in the next preceding third enclosure 27C. For example, the atmospheric pressure in each of the enclosures 27A, 27B, and 27C may be maintained by a closed loop regulating device.

Further the third enclosure 27C may be sealed relative to the second enclosure 27B in order to prevent excess steam from the cooling process in the third enclosure 27C from entering the rolling mill 32.

The cast strip 21 will undergo some stress in the first enclosure 27A. This stress is at least in part due to thermal strains and mechanical strains put on the cast strip 21 in the loop 70 and as it moves toward and through first pinch rolls 31A. The angle at which the cast strip 21 leaves the nip of the casting rolls 12, the nip angle, and the angle at which the cast strip 21 approaches the first roller table 30, the wrap angle, are both factors to control the amount of stress imposed upon the cast strip 21. The wrap angle influences the stress in the cast strip adjacent entry to the roller table 30 both before and after the entry to the first roll 71A on roller table 30. Additionally, the height of the loop 70 is also a factor in controlling the amount of stress imposed upon the cast strip 21.

The configurations for the first roller table 30 and loop 70 of the cast strip 21, as shown in FIG. 1 tends to allow for a maximum strain of 0.7% on the cast strip 21. This configuration includes all of the rollers 71A-H of the roller table 30 being sized at, for example, 210 mm in diameter and configured with the tops of all of the rollers 71A-H being aligned substantially horizontally. Generally the maximum strain in the cast strip 21 in the first enclosure occurs as the strip leaves the loop 70 and is directed to the first pinch rolls 31A at the entry to the first roll 71A of the first roller table 30.

There are shown is FIGS. 5-10 several alternative configurations for the first roller table 30 and configurations for the loop 70 of the cast strip 21.

Figure 5:
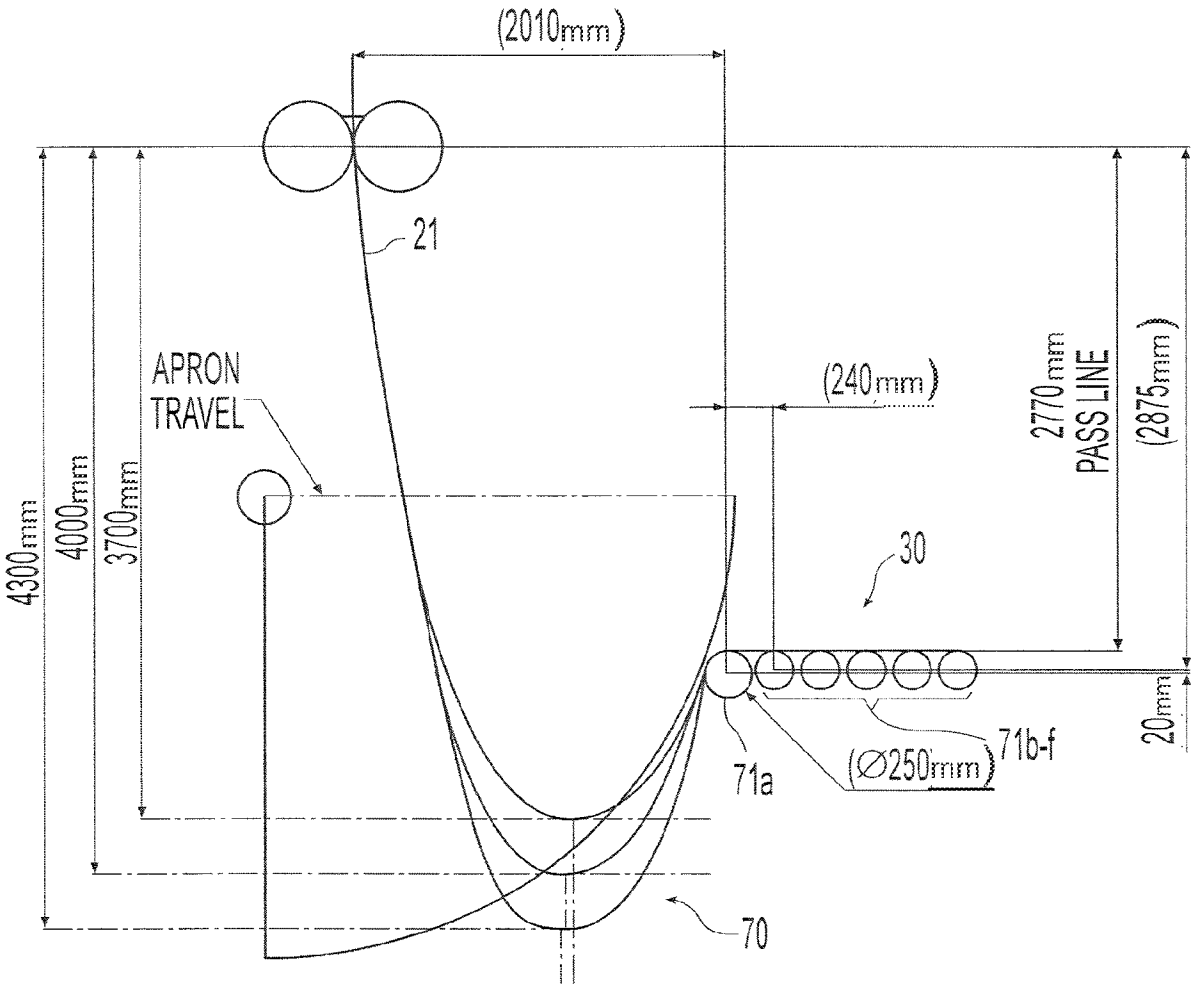
FIG. 5 is a representative diagram of a strip loop and roller table configuration according to a second embodiment.

There is shown in FIG. 5 loop in the first enclosure of apparatus for continuously casting thin strip may be between 2.5 and 4.5 meters in height. This configuration tends to allow for a maximum strain of 0.7%. This configuration includes a first roller 71A being sized at 250 mm with all of the remaining rollers 71B-F being sized at 210 mm in diameter. In this configuration the tops of all of the rollers 71B-F are aligned substantially horizontally.

In FIG. 5 (as well as FIGS. 6-10) the loop 70 is illustrated in a variety of heights. The difference in these heights results in a variety of different distance between the bottom of the loop 70 and the nip of the casting rolls 12. The loop 70 is between 2.5 to 4.5 meters in height measured from the bottom of the loop 70 to nip of the casting rolls 12. The height of the loop 70 may be controlled in whole or in part by differential speed between the casting rolls 12 and the first pinch rolls 31A. The loop height set then in turn affects the angle of the strip from the nip of the casting rolls 12 and angle to the roller table 30. Generally, a shorter height of the loop 70 produces a more acute nip angle and a less acute wrap angle, thus tending to resulting in more stress near the nip and less stress at entry to the first roll 71A of the first roll table 30. It must be understood, however, that the maximum amount of stress which the cast strip may tolerate may also be influenced by the thickness and temperature of the cast strip 21, among other properties.

Figure 6:
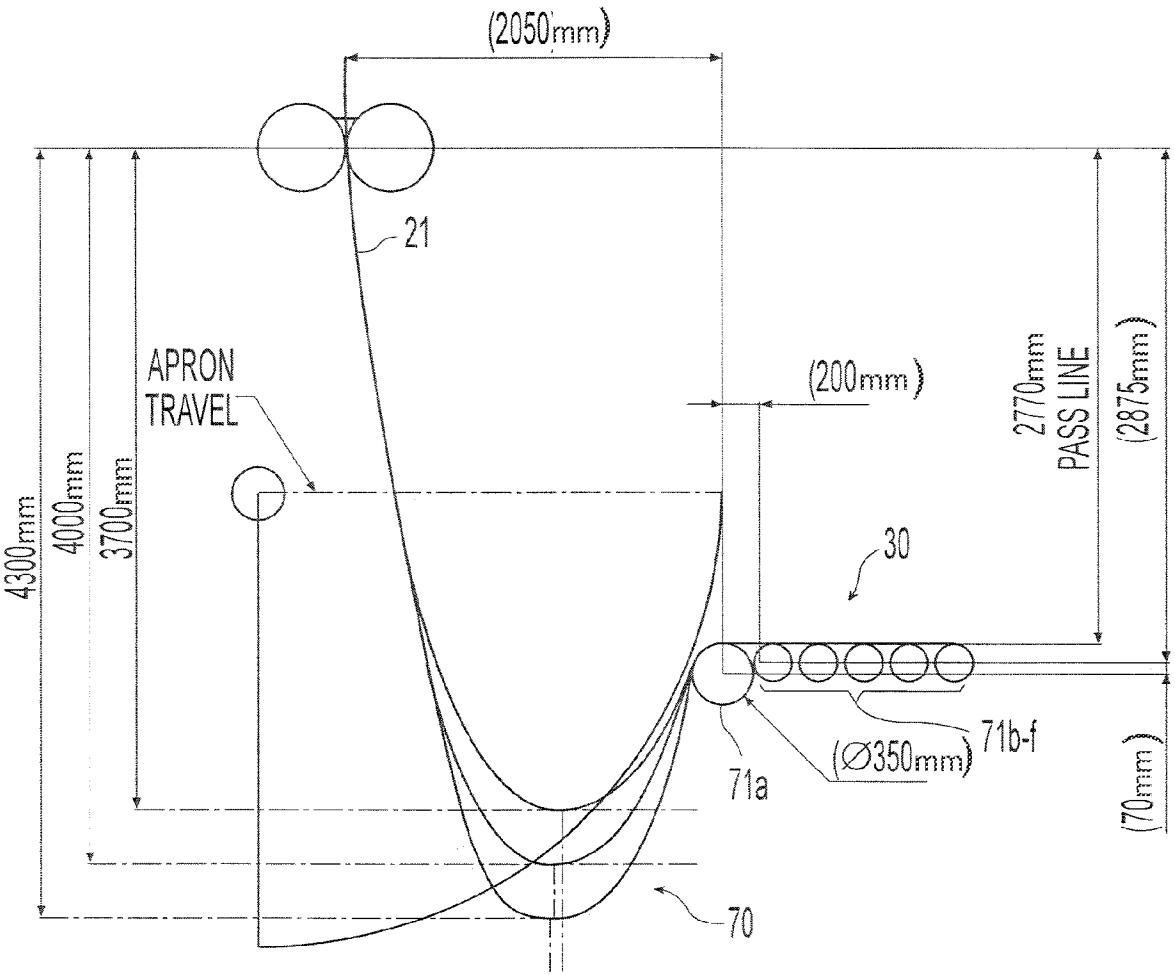
FIG. 6 is a representative diagram of a strip loop and roller table configuration according to a third embodiment.

There is shown in FIG. 6 a configuration according to another embodiment. This configuration provides for a maximum strain of 0.5%. This configuration includes a first roller 71A being sized at 350 mm with all of the remaining rollers 71B-F being sized at 210 mm in diameter. In this configuration the tops of all of the rollers 71A-F are aligned substantially horizontally. The larger diameter of the first roller 71A, as compared to the remaining rollers 71B-F, limits the amount possible of strip curvature at the first roller table 30 (as the curvature of the strip during contact with the roll is inversely proportional to the radius, i.e. half the diameter, of the roller) and thus reduces the bending strain at the first roller table 30, as compared to other roller tables.

Figure 7:
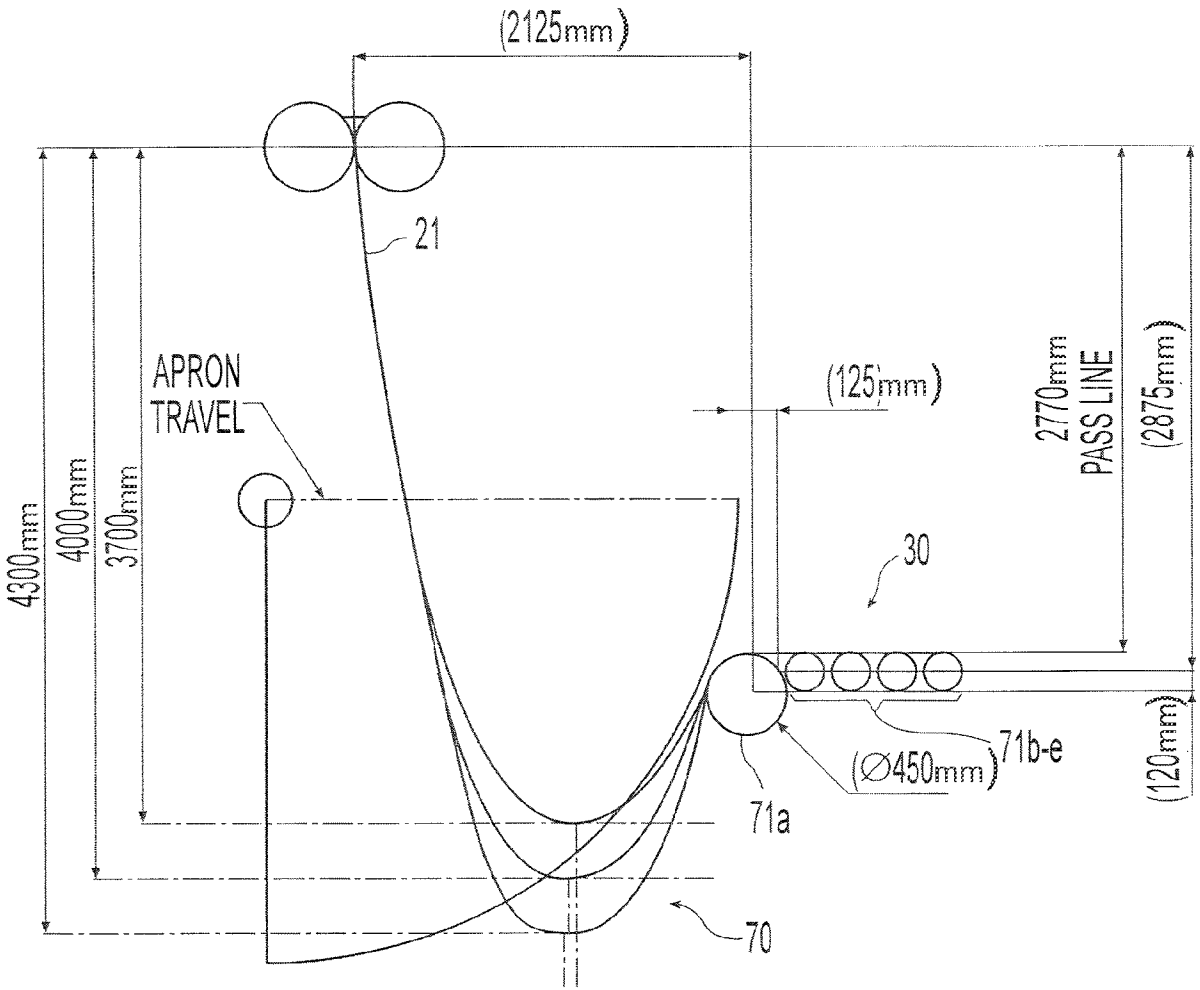
FIG. 7 is a representative diagram of a strip loop and roller table configuration according to a fourth embodiment.

There is shown in FIG. 7 a configuration according to another embodiment. This configuration provides for a maximum strain of 0.4%. This configuration includes a first roller 71A being sized at 450 mm with all of the remaining rollers 71B-E being sized at 210 mm in diameter. In this configuration the tops of all of the rollers 71A-E are aligned substantially horizontally.

Figure 8:
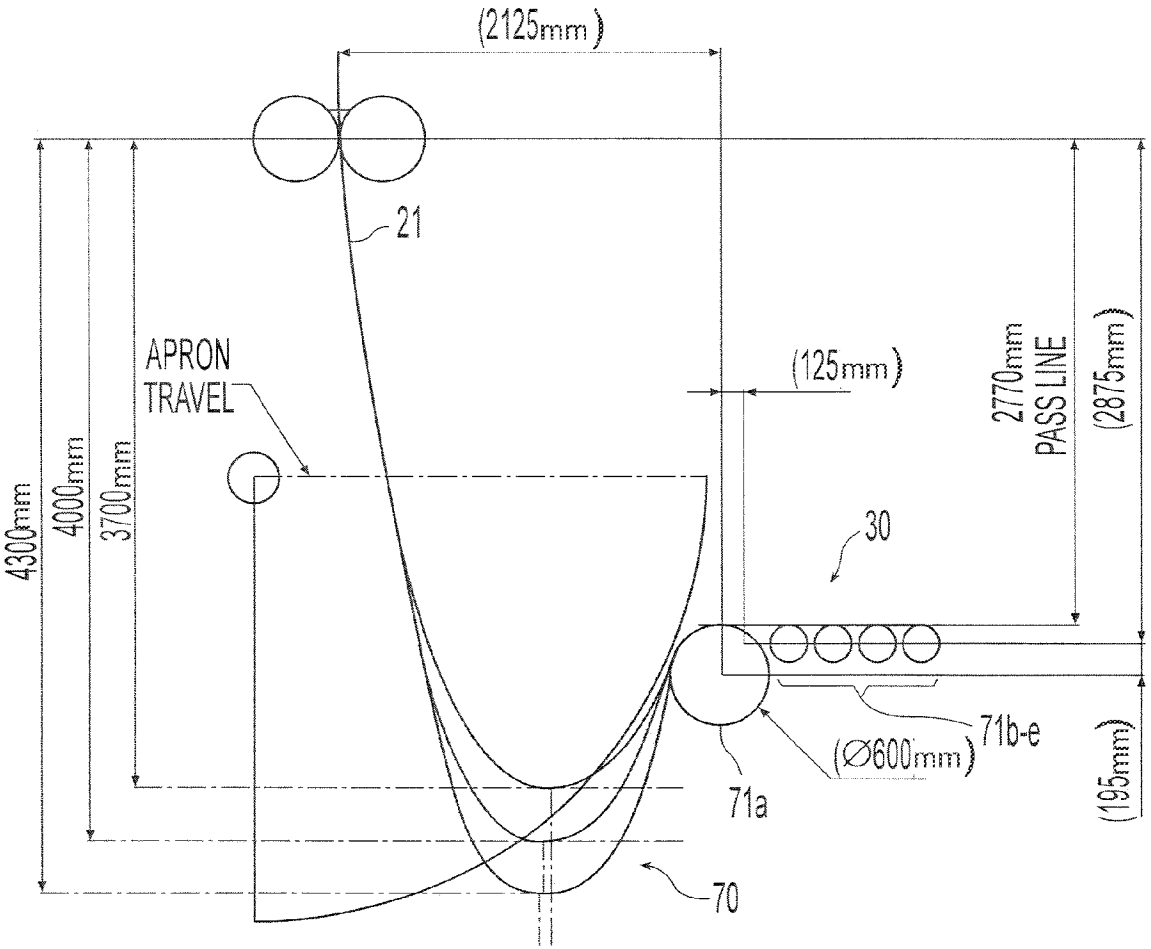
FIG. 8 is a representative diagram of a strip loop and roller table configuration according to a fifth embodiment.

There is shown in FIG. 8 a configuration according to another embodiment. This configuration provides for a maximum strain of 0.3%. This configuration includes a first roller 71A being sized at 600 mm with all of the remaining rollers 71B-E being sized at 210 mm in diameter. In this configuration the tops of all of the rollers 71A-E are aligned substantially horizontally.

Figure 9:
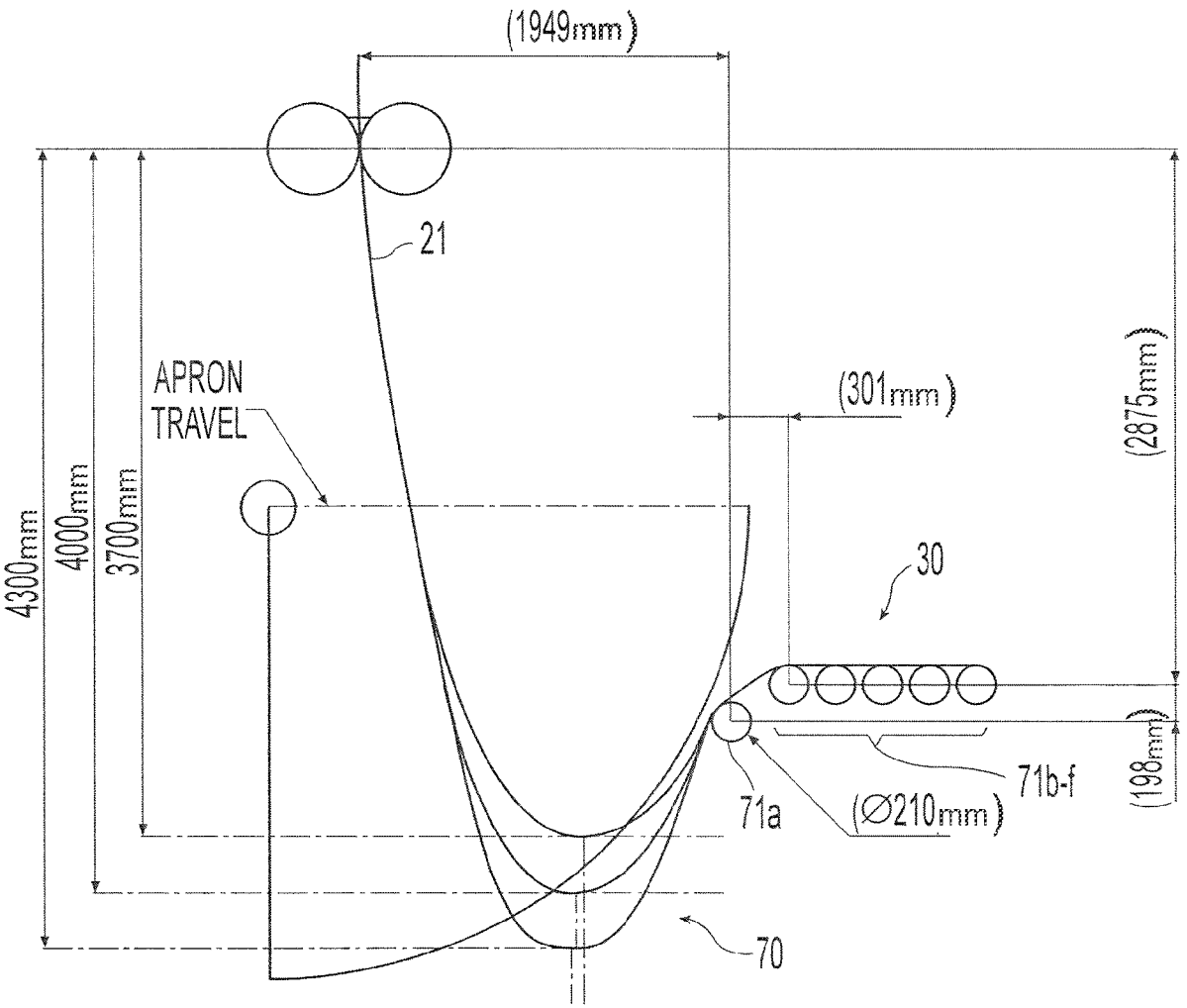
FIG. 9 is a representative diagram of a strip loop and roller table configuration according to a sixth embodiment.

There is shown in FIG. 9 a configuration according to another embodiment. This configuration provides for a maximum strain of 0.3%. This configuration includes all of the rollers 71A-F being sized at 210 mm in diameter. In this configuration the first roller 71A is lowered 198 mm relative to the remainder of the rolls 71B-F. The tops of the remainder of the rollers 71B-F are aligned substantially horizontally.

Figure 10:
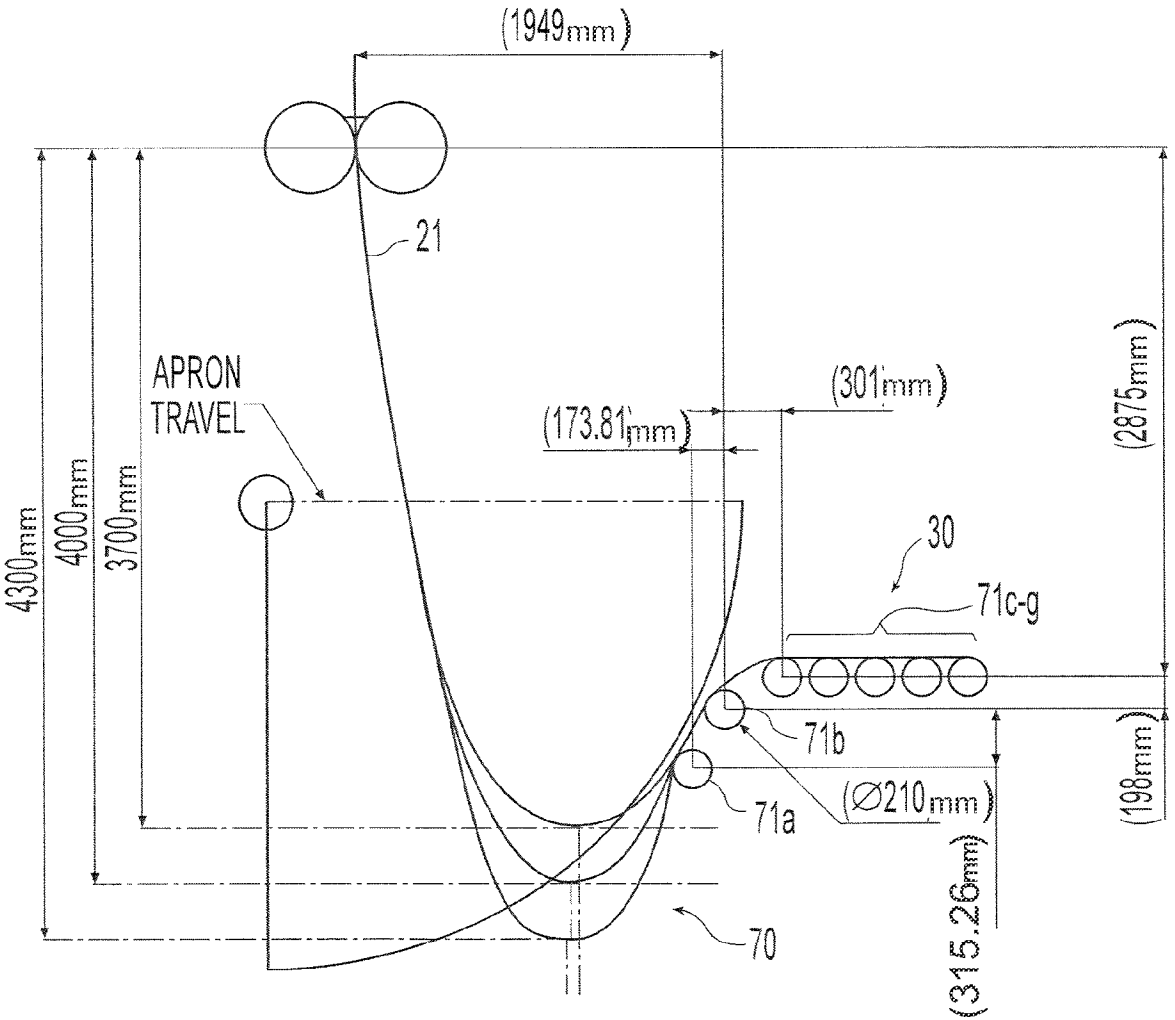
FIG. 10 is a representative diagram of a strip loop and roller table configuration according to a seventh embodiment.

There is shown in FIG. 10 a configuration according to another embodiment. This configuration provides for a maximum strain of 0.25%. This configuration includes all of the rollers 71A-F being sized at 210 mm in diameter. In this configuration the first roller 71A is lowered 513.26 mm and a second roller 71B is lowered 198 mm relative to the remainder of the rolls 71C-G. The tops of the remainder of the rollers 71C-G are aligned substantially horizontally.

Thus, the cast strip 21 is subjected to less strain in the loop 70 by providing a plurality of rollers 71 of the roller table 30, at entry of the strip cast into the first pinch roll stand 31, to carry the cast strip 21 into the first pinch roll stand 31. For example the roller table 30 may include at least one of a first roller being below a majority of the remainder of rollers or having a first roller having a diameter between 200 and 650 millimeters but greater than that of a majority of the remainder of the rollers.

There is shown in FIG. 11 a data table 100 illustrating the estimated maximum loop strains for the configurations of FIGS. 1 and 5-10.

One method of controlling the stress on the cast strip 21, particularly for controlling the surface cracking, including maintaining the strain on the cast strip 21 in the loop 70 at less than 0.3%. This may be achieved through one or a combination of the configuration of the roller table 30, the configuration for the loop 70 of the cast strip 21, including the height of the loop 70 height relative to the roller table 30, and the tension on the cast strip 21 set by the first pinch rolls 31A. A strain measurement system including a camera to monitor the nip angle, loop height, or wrap angle and a strain calculator programmed with a strain calculation formula, may monitor the cast strip 21 to measure the strain. A control device, for example including a processor programmed with a strain penalty function, may evaluate the strain measurement and adjust the geometry of the cast strip 21 to a desired configuration.

In operation, once a particular caster configuration is assembled the loop height may be controlled as to the vertical distance between the casting nip and the loop bottom to control the strain in the cast strip. The magnitude of different strains, such from bending or strip weight, may be controlled in order to avoid strip cracking and tearing of the strip the strains within the strip. A desired loop height, such as a height that keeps strain at the nip, loop and entry to the table at a minimum, may vary by configuration. Generally, when loop height is increased, bending strains at the nip are reduced while strains at the loop bottom and table roll entry increase. Generally in stress minimization, all of these localized stresses may be considered.

The strains in the cast strip may be quantified and then the geometry of the cast strip adjusted to minimize the overall strain, including the localized strains.

Figure 12:
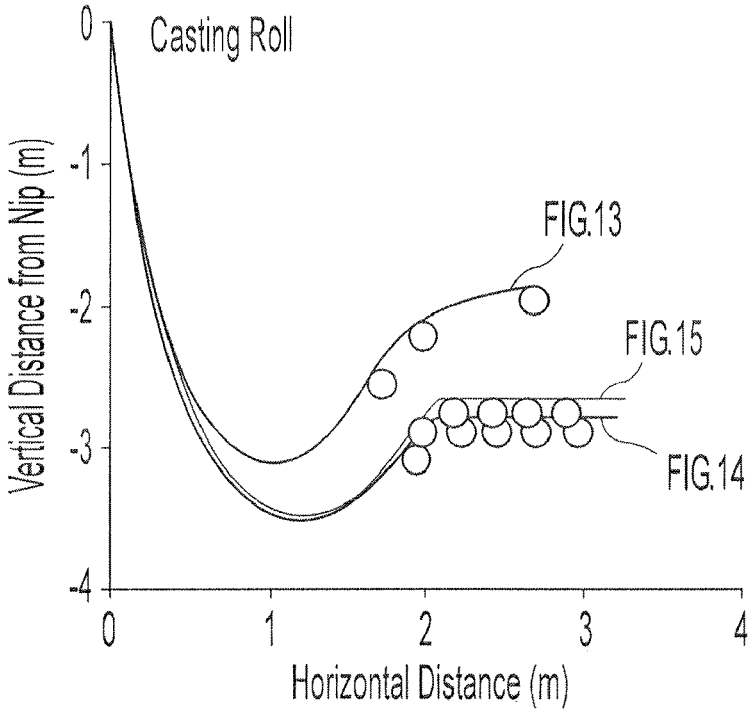
FIG. 12 is a diagram illustrating the geometry of three strip casters.
Figure 13:
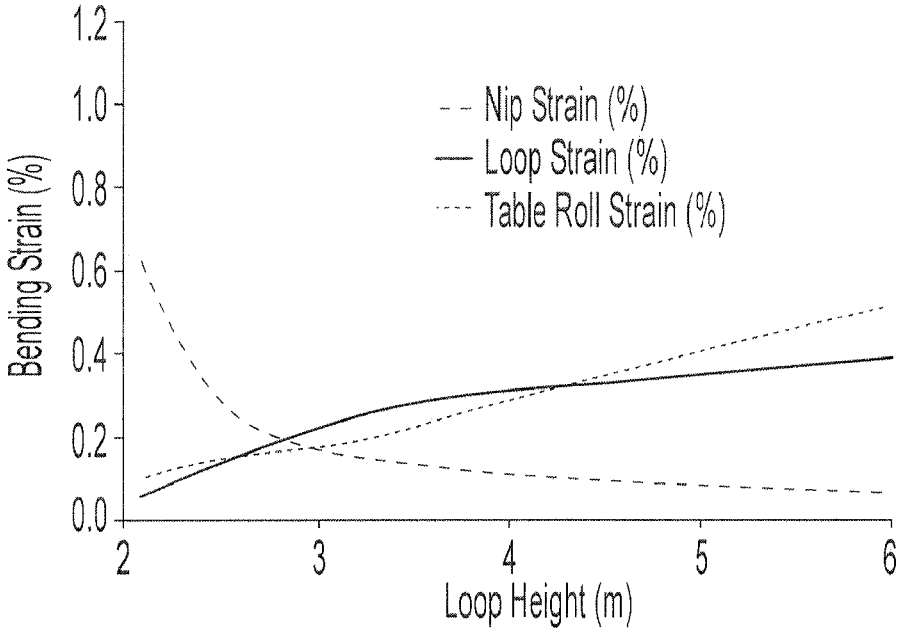
FIG. 13 is a graph illustrating a strain profile of a first one of the three strip casters illustrated in FIG. 12.
Figure 14:
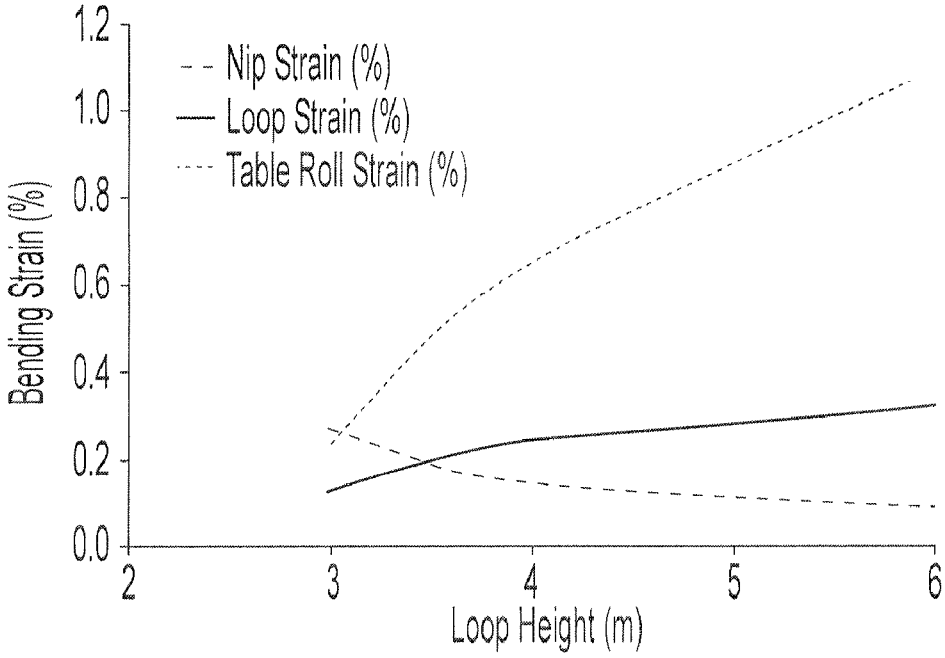
FIG. 14 is a graph illustrating a strain profile of a second one of the three strip casters illustrated in FIG. 12.
Figure 15:
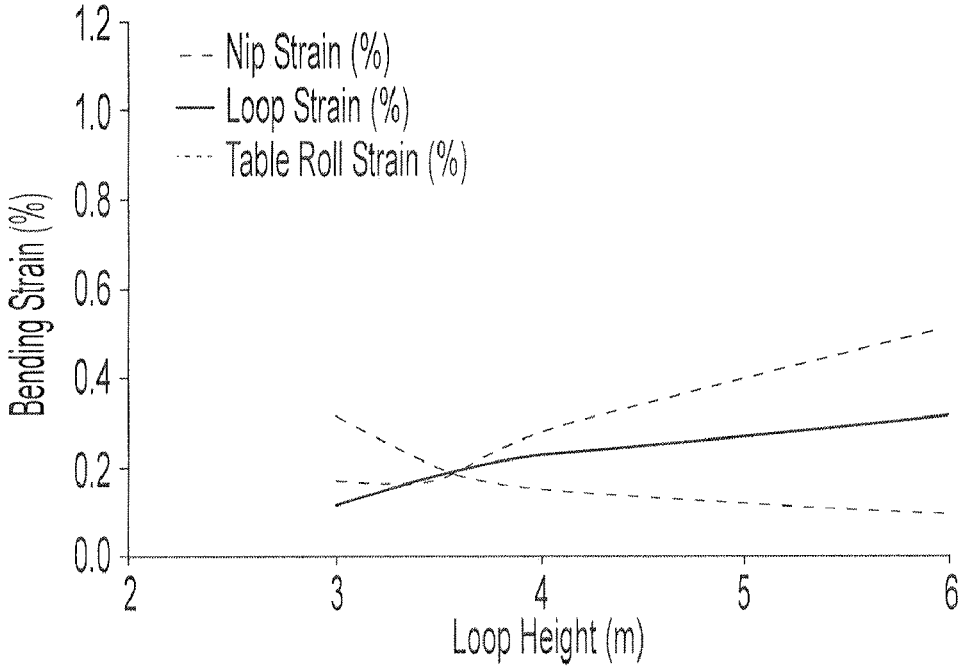
FIG. 15 is a graph illustrating a strain profile of a third one of the three strip casters illustrated in FIG. 12.

There is shown in FIG. 12 a schematic diagram illustrating the geometry of three strip casters having their strain profiles shown in FIGS. 13-15 respectively.

One method of stress minimization includes minimizing a strain penalty function defined as:

$$F=|w_N\epsilon_N|+|w_L\epsilon_L|+|w_T\epsilon_T| \tag{1}$$

where $w_N$, $w_L$ and $w_T$ are weighting terms that increase as the necessary strain for cracking decreases at the nip, in the loop and adjacent entry to the roller table respectively. For example, the weighting at the nip may be higher than at the table rolls as the strip is hotter at the nip and has less resistance to cracking. These weighting terms may be, for example, derived from Gleeble testing.

The strip surface strains from bending $\epsilon^b$, as the strip travels between the nip and the table rolls, can be found from the strip thickness h and the bending curvature κ of the strip given by;

$$\varepsilon^b = \frac{1}{2}\kappa h \tag{2}$$

These strains are generally maximum at the strip surface.

The local strip curvature can be calculated by solving a Heavy Elastica Equation which takes into account:

the horizontal tension applied to the strip from downstream, the weight on a strip section, which varies along the length between the nip and the table rolls, for example the strip at the nip carries more weight than that at the loop bottom, the resistance to bending due to the flexural rigidity of the strip, which is dependent on the elastic modulus of the strip and its thickness where a thicker strip has more bending resistance, and the condition that the strip exits the nip between the casting rolls vertically, together with the conditions that there is smooth tangential contact of the strip over the appropriate table roll at the correct position with respect to the nip.

The influence of the conditions may be obtained by applying boundary conditions when solving the Heavy Elastica Equation at the nip and table roll.

The Heavy Elastica Equation is given by:

$$D\frac{d\kappa}{ds} = -V\cos\theta + H\sin\theta,\ \kappa = \frac{d\theta}{ds} \tag{3}$$

where s is the distance along the strip length, θ is the local angle of the strip to the horizontal and D is the flexural rigidity given by:

$$D = \frac{Eh^3}{12(1-v^2)} \tag{4}$$

Where E is the elastic modulus of the strip and v the Poisson's ratio. The terms H and V are the horizontal and vertical forces per unit width respectively, with the latter accounting for the weight the local section of the strip is supporting.

For example, the strip exits the nip vertically with θ=90° under the full weight of the strip below. The change in curvature along the strip length, and hence strip angle to the horizontal, can be found from Eqn. (3). The reduction in weight, per unit width, on the strip section is then calculated along the strip length and the value of V updated. In this way the variation in curvature can be calculated along the strip length, and hence the bending strain at the strip surface according to Eqn. (2). From the variation of the angle to the horizontal θ with length of strip from the nip s the variation in vertical height of the strip with strip length between the nip and table rolls can be calculated. The horizontal tension force per unit width H is then found such that the strip correctly meets the first table roll of contact. In this way the maximum strains at the nip, loop and table roll regions can be calculated for a given cast strip geometry and the cast strip geometry may be controlled to minimize those strains, either directly or in a weighted fashion as exemplified in equation 1.

While particular embodiments have been illustrated and described in detail in the drawings and foregoing description, the same is to be considered as illustrative and not restrictive in character, it being understood that only a number of exemplary embodiments have been shown and described and that all changes and modifications that come within the spirit of the invention are desired to be protected. Thus, while principles and modes of operation have been explained and illustrated with regard to particular embodiments, it must be understood, however, that these may be practiced otherwise than as specifically explained and illustrated without departing from spirit or scope.

What is claimed is:

1. An apparatus for continuously casting thin strip comprising:

a. a caster having a pair of counter-rotated casting rolls having a nip there between capable of delivering cast strip downwardly from the nip, b. a metal delivery system capable of forming a casting pool supported on casting surfaces of the casting rolls above the nip with side dams adjacent ends of the nip to confine the casting pool, c. a first enclosure beneath the casting capable of forming a protective atmosphere into which the strip can be delivered from the casting rolls to form a loop, then onto a roller table and through counter rotating pinch rolls, d. a device for determining strains in the cast strip in at least two locations selected from the group consisting of a location adjacent the nip, a location adjacent bottom portions of the loop, and a location adjacent entry to the roller table, and e. a control system capable of comparing the determined strains and controlling loop height, rotation of the casting rolls and rotation of the pinch rolls to maintain the strain in the strip in the first enclosure below a predetermined value.

2. The apparatus for continuously casting thin strip as claimed in claim 1 where the predetermined strain value is a value of less than 0.4%.

3. The apparatus for continuously casting thin strip as claimed in claim 1 where the predetermined strain value is a value of less than 0.3%.

4. The apparatus for continuously casting thin strip as claimed in claim 1 comprising in addition:

f. where each enclosure between the casting rolls and a coiler through which the strip passes after leaving the first enclosure have an atmospheric pressure less than a pressure in the first enclosure and less than the atmospheric pressure in a next preceding enclosure.

5. The apparatus for continuously casting thin strip as claimed in claim 1 comprising in addition:

f. a second enclosure extending from adjacent pinch rolls to a hot rolling mill through which the strip can move on rollers, the rollers sloping a way from a first enclosure so as to inhibit water from flowing into the first enclosure.

6. The apparatus for continuously casting thin strip as claimed in claim 4 where the atmospheric pressure in each enclosure is maintained by a closed loop regulating device.

7. The apparatus for continuously casting thin strip as claimed in claim 4 where an atmospheric pressure in the first enclosure is less than 0.5 inches on a water gauge, and the atmospheric pressure of each subsequent enclosure being at least 0.03 inches on a water gauge than a next proceeding enclosure.

8. The apparatus for continuously casting thin strip as claimed in claim 1 where the roller table includes a first entry roller with a diameter between 200 and 650 millimeters and being below a majority of the other rollers in the roller table.

* * * * *